US007361049B2

(12) United States Patent
Nagata et al.

(10) Patent No.: US 7,361,049 B2
(45) Date of Patent: Apr. 22, 2008

(54) ATTACHMENT PART, AND CONNECTOR AND ELECTRONIC DEVICE FOR CONNECTION TO SAME ATTACHMENT PART

(75) Inventors: Takayuki Nagata, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 11/656,944

(22) Filed: Jan. 24, 2007

(65) Prior Publication Data

US 2007/0184710 A1 Aug. 9, 2007

(30) Foreign Application Priority Data

Feb. 9, 2006 (JP) ..... 2006-032293

(51) Int. Cl.
*H01R 12/24* (2006.01)

(52) U.S. Cl. ..... 439/497; 439/579

(58) Field of Classification Search ..... 439/497, 439/498, 579, 607, 578, 609
See application file for complete search history.

(56) References Cited

U.S. PATENT DOCUMENTS 6,273,753 B1 * 8/2001 Ko ..... 439/579
6,364,701 B1 * 4/2002 O'Sullivan et al. ..... 439/579
7,001,213 B2 * 2/2006 Kaneko et al. ..... 439/579
7,156,678 B2 * 1/2007 Feldman et al. ..... 439/326
7,192,301 B2 * 3/2007 Kuroda et al. ..... 439/497
2005/0272312 A1 * 12/2005 Hashiguchi et al. ..... 439/578
2006/0252310 A1 * 11/2006 Yamada et al. ..... 439/579

FOREIGN PATENT DOCUMENTS

JP 2002-8765 1/2002

* cited by examiner

*Primary Examiner*—Hien Vu
(74) *Attorney, Agent, or Firm*—Kratz, Quintos & Hanson, LLP

(57) ABSTRACT

An attachment part serves as a ground bar in a substantially U shape in a cross-sectional view, and has a rectangular first side wall portion provided upright along one widthwise end portion of a bottom plate portion, and an inverted L-shaped second side wall portion provided upright along the other widthwise end portion of the bottom plate portion. The first side wall portion is provided with a plurality of first slots for receiving four first signal lines exposed from first external insulators and first shield conductors of the plurality of composite cables. The second side wall portion is provided with a plurality of second slots for receiving the first shield conductors exposed from the first external insulators of the plurality of composite cables.

16 Claims, 11 Drawing Sheets

(a)

(b)

ATTACHMENT PART, AND CONNECTOR AND ELECTRONIC DEVICE FOR CONNECTION TO SAME ATTACHMENT PART

The present application claims priority under 35 U.S.C. §119 of Japanese Patent Application No. 2006-32293 filed on Feb. 9, 2006, the disclosure of which is expressly incorporated by reference herein in its entity.

BACKGROUND OF THE INVENTION

1. Field of the Invention

The present invention relates to an attachment part to which a cable such as a composite cable is attached, and a connecter and an electronic device that include the same attachment part.

2. Description of the Related Art

As this type of connector, there is a connector in which a plurality of cables are arranged in parallel, and shield conductors are connected in an integrated state by soldering connection. Specifically, a soldering portion (ground bar) to which the shield conductors of the plurality of cables are integrally connected is electrically connected to a shield member of the connector, while connection conductors of the relevant cables are electrically connected to terminal portions of the relevant connector.

This connector is provided with groove portions for positioning the cables at connection positions of the terminal portions, as disclosed in Japanese Patent Application Laid-Open No. 2002-8765.

As the cables, there is a composite cable having a plurality of signal lines in which connecting conductors are covered with internal insulators, a shield conductor covering the whole of this plurality of signal lines, and an external insulator covering this shield conductor. In the case of such a composite cable, the respective signal lines need to be disposed in a predetermined arrangement so as to be connected to the corresponding terminal portions of the connecter.

However, even if the relevant connector is provided with the groove portions, it is very difficult to dispose the plurality of the signal lines of the composite cable on the connector in the predetermined arrangement and position them at the connection positions of the terminal portions, which may causes miswiring. Particularly in the case where the connector is small-sized, arranging and positioning work is more difficult. Moreover, if the arranging and positioning of the signal lines is performed on the connector, it is difficult to check the arrangement of the signal lines, which easily causes miswiring. Once the signal lines are connected to the terminal portions, because the signal lines are pressure-contacted or soldered to the terminal portions, the miswired signal lines cannot be rewired easily. Furthermore, if a plurality of composite cables are connected in the soldering portion, the respective composite cables cannot be dealt with freely, which makes it difficult to arrange the respective signal lines of the composite cables.

SUMMARY OF THE INVENTION

The present invention is made in light of the above-described situation, and an object thereof is to provide an attachment part that will ease the arrangement and positioning of the signal lines of the composition cables, the check of proper arrangement of the signal lines, and the rewiring of the signal lines, and a connector and an electronic device to which such attachment part is attached.

In order to achieve the above-described object, an the present invention is directed to an attachment part for attaching a composite cable thereto, the composite cable including a plurality of first signal lines in which first connecting conductors are covered with first internal insulators, a first shield conductor covering the whole of this plurality of first signal lines, and a first external insulator covering this first shield conductor, the attachment part including a plurality of firsts lots for receiving the plurality of first signal lines exposed from the first external insulator and the first shield conductor of the composite cable.

According to such an attachment part, the alignment and positioning of the respective signal lines can be performed easily only by inserting the plurality of first signal lines exposed from the first external insulator and the first shield conductor of the composite cable into the plurality of first slots. Additionally, the check of proper arrangement of the respective signal lines can be performed in a state where the signal lines are inserted into the first slots before the attachment of the connector. As a result of this check, if misarrangement of the signal lines is found, the relevant signal lines are taken out of the first slots to be inserted into the proper first slots, by which the relevant signal lines can be rewired easily.

The attachment part preferably possess electrical conductivity and has a substantially U shape in a cross-sectional view. The attachment part maybe provided with, in one end portion thereof in a width direction, said plurality of first slot, and, in the other end portion thereof in the width direction, a second slot for receiving and contacting the first shield conductor exposed from the first external insulator of said composite cable. That is, the first shield conductor of the composite cable is inserted into the second slot to make contacts, which allows the attachment part to serve as a ground bar. The attachment part of the invention can offer an advantage of obviating an extra step of connecting the composite cable to the ground, by electrically connecting the attachment part to a ground connection portion of the connector.

It is preferable that the first signal lines of the composite cable are press-fitted into the first slots, and it is preferable that the first shield conductor of the composite cable is press-fitted into the second slot. In this case, when the composite cable is attached to the attachment part, the composite cable can be prevented from dropping off, and when the composite cable is attached to the connector together with the attachment part, the composite cable can be prevented from dropping off. Therefore, workability in the attachment work of the composite cable to the attachment part and in the attachment work of the composite cable and the attachment part to the connector is improved. Furthermore, press-fitting the first shield conductor of the composite cable into the second slot enables stable electric connection between the first shield conductor and the attachment part.

The attachment part may have a constitution capable of attaching a coaxial cable having a second signal line in which a second connecting conductor is covered with a second internal insulator, a second shield conductor covering this second signal line, and a second external insulator covering this second shield conductor in addition to the composite cable. In such case, the attachment part may be provided with, in the one end portion, a third slot into which the second signal line exposed from the second external insulator and the second shield conductor of the coaxial cable is inserted and, in the other end portion, a fourth slot for receiving and contacting the second shield conductor exposed from the second external insulator of the coaxial cable.

Such an attachment part offers convenience in that not only the composite cable but also the coaxial cable can be arranged and positioned together. Additionally, the coaxial cable can be easily connected to the ground as in the composite cable as described above.

It is preferable that the second signal line of the coaxial cable is press-fitted into the third slot, and it is preferable that the second shield conductor of the coaxial cable is press-fitted into the fourth slot. In this case, the coaxial cable can be prevented from dropping off when the coaxial cable is attached to the attachment part, and the coaxial cable can be prevented from dropping off when the coaxial cable is attached to the connector together with the attachment part. Therefore, workability in the attachment work of the coaxial cable to the attachment part and in the attachment work of the composite cable, the coaxial cable and the attachment part to the connector is improved. Furthermore, press-fitting the second shield conductor of the coaxial cable into the fourth slot enables stable electric connection between the second shield conductor and the attachment part.

A connector of the invention of the application may includes terminal portions for electrically connecting to the first connecting conductors of the composite cable, a body having an insulation property in which the terminal portions are provided, and a shield member provided in this body for electrically connecting to the attachment part.

Another connector of the invention of the application may include terminal portions for electrically connecting to the first connecting conductors of the composite cable and the second connecting conductor of the coaxial cable, a body having an insulation property in which these terminal portions are provided, and a shield member provided in this body for electrically connecting to the attachment part.

The shield member may be arranged between the terminal portions and the attachment part, and the shield cover may hold the attachment part between the shield member and itself in an attached state to the body. In this manner, since the attachment part is only held between the shield member and the shield cover, the attachment part can be easily attached to the connector, which can reduce incorporation cost. Additionally, since the shield member is located between the terminal portions and the attachment part with the cable attached, a signal leaking out from the shield conductor of the cable can be shut off not to be absorbed by the adjacent terminal portion. Therefore, the generation of the cross talk due to the absorption of the signal by the adjacent terminal portion can be reduced. Furthermore, since the attachment part connected to the cable is sandwiched between the shield member and the shield cover, a signal leaking out from the shield conductor of the cable can also be shut off not to affect the respective units of the electronic device on which the relevant connector is mounted. Therefore, a connector having higher shield properties as compared with a conventional example can be attained.

According to the attachment part of the present invention, the arrangement and positioning of the respective signal lines can be performed easily, only by inserting into the first slot the plurality of first signal lines exposed from the first external insulator and the first shield conductor of the composite cable. Additionally, since the check of the arrangement of the respective signal lines can be performed before the attachment of the connector in a state where the signal lines are inserted into the first slots, the check becomes easy. As a result of this check, if misarrangement of the signal lines is found, the relevant signal lines can be rewired easily, and thus, failure of the composite cable and the connector due to the connection of the miswired signal lines to the connector can be prevented.

DETAILED DESCRIPTION OF THE PREFERRED EMBODIMENTS

Hereinafter, embodiments of the present invention are described.

Embodiment 1

Figure 1:
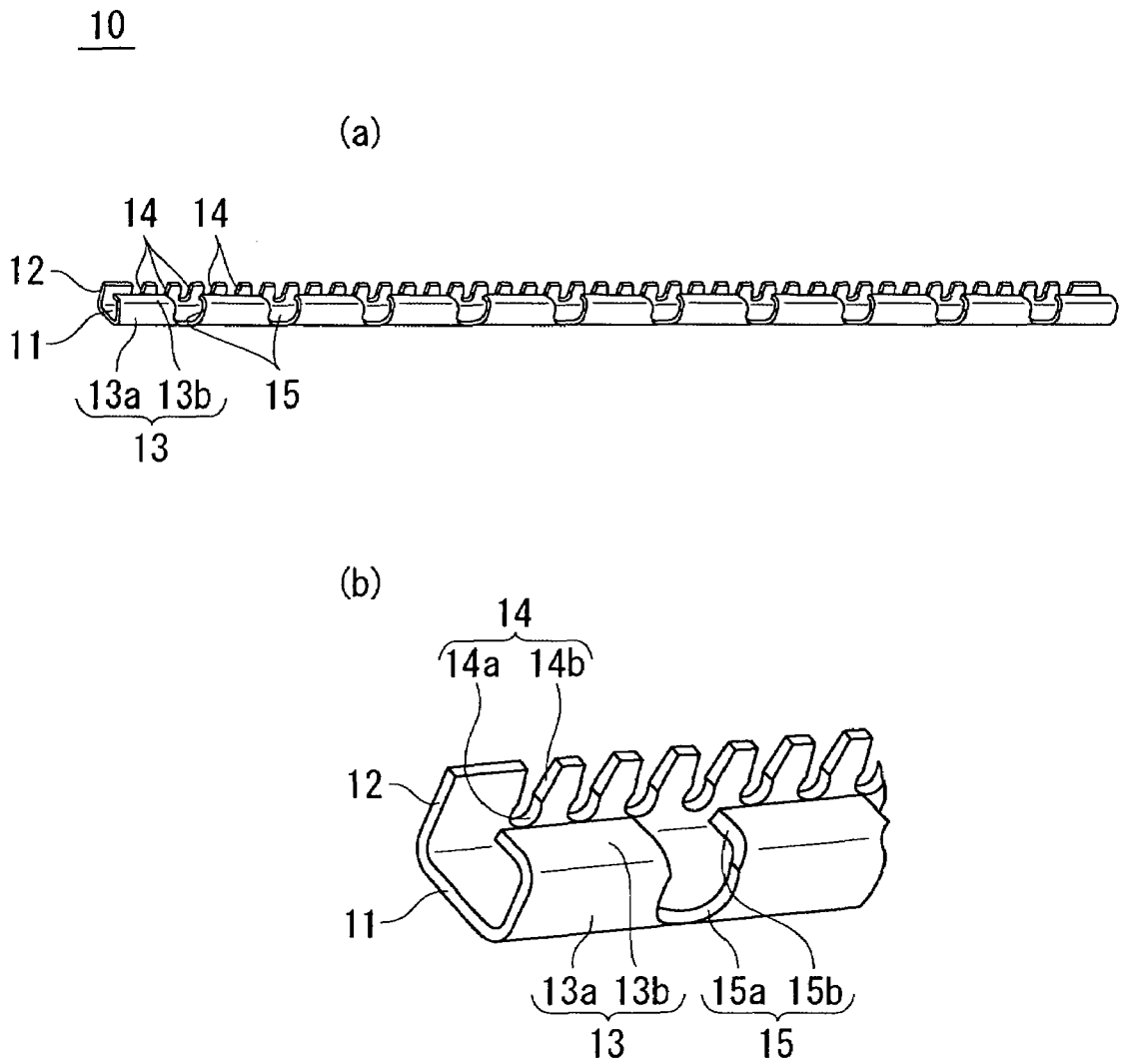
FIG. 1 is schematic perspective views of an attachment part according to a first embodiment of the present invention, (a) being a view showing the whole, (b) being a partially enlarged view.

First, an attachment part according to a first embodiment of the present invention is described with reference to the drawings. FIG. 1 is schematic perspective views of the attachment part according to the first embodiment of the present invention, (a) being a view showing the whole, (b) being a partially enlarged view, and FIG. 2 is a schematic perspective view showing a composite cable attached state of the same attachment part.

Figure 2:
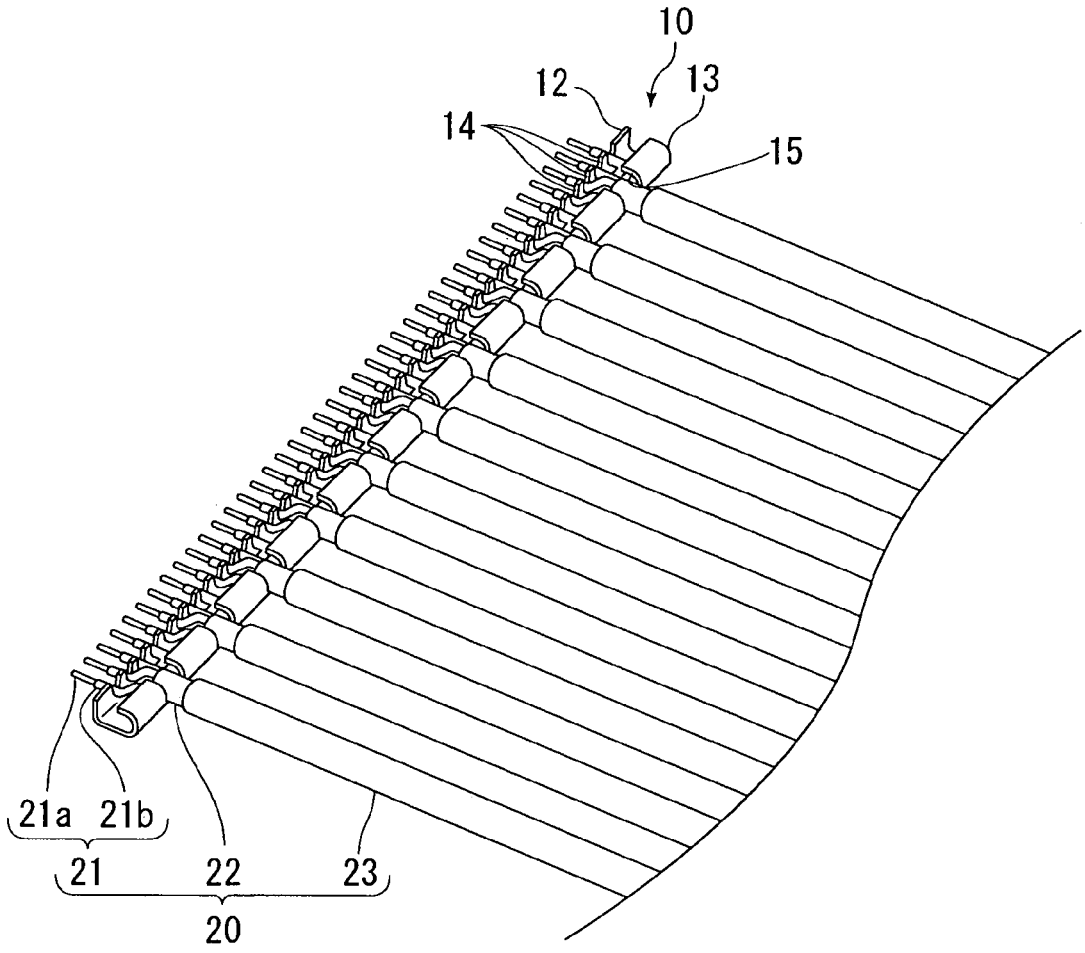
FIG. 2 is a schematic perspective view showing a composite cable attached state of the same attachment part.

The attachment part 10 shown in FIGS. 1 and 2 serves as a ground bar to which a plurality of composite cables 20 is attached.

The composite cable 20 is a well-known one having first connecting conductors 21*a*, four first signal lines 21 covered with first internal insulators 21*b* made of polyethylene or the like, a first shield conductor 22 formed of aluminum or the like, which covers the whole of these four first signal lines 21, and an external insulator 23 of polyvinyl chloride or the like, which covers this first shield conductor 22. Outer surfaces of the first internal insulators 21*b* of the first signal lines 21 are colored differently in order to be distinguished from each other.

The attachment part 10 is a conductive, substantially recessed member in a cross-sectional view, and is shaped so as to have a rectangular bottom plate portion 11, a first rectangular side wall portion 12 provided upright at one end portion in a width direction of this bottom plate portion 11 (that is, one end portion in the width direction of the attachment part 10), and an inverted L-shaped second side wall portion 13 provided upright at another end portion in the width direction of the bottom plate portion 11 (that is, another end portion in the width direction of the attachment part 10). Hereinafter, a detailed description is given.

The bottom plate portion 11 is a contact part that comes into surface contact with a shield member 300 of a connector A described later.

The first side wall portion 12 is provided with a plurality of first slots 14 into which the four first signal lines 21 exposed from the first external insulator 23 and the first shield conductor 22 of the plurality of composite cables 20 are inserted, at predetermined intervals in a longitudinal direction of the relevant first side wall portion 12.

Each of these first slots 14 is a substantially U-shaped groove portion, and has a first hole portion 14*a* forming a lower portion and a first introduction portion 14*b* forming an upper portion.

The first hole portion 14*a* is a circular hole that has a little smaller diameter than the first signal line 21 of the composite cable 20 and opens at an upper portion thereof, and a width dimension of both edge portions of the opening portion is made smaller than a diameter of the first signal line 21. This allows the first signal line 21 to be press-fitted into the first hole portion 14*a* and be held. In this manner, press-fitting the first signal line 21 into the first hole portion 14*a* prevents the relevant first signal line 21 from dropping off from the first slot 14 at the time of attachment of the relevant first signal lines 21 and at the time of attachment of the attachment part 10 to the connector A, which will be described later. The first hole portion 14*a* is formed so as to be sized such that the first internal insulator 21*b* of the first signal line 21 is not ruptured when the first signal line 21 is press-fitted.

Furthermore, the first introduction portion 14*b* is an opening continuing from the opening portion of the first hole portion 14*a*, and both end surfaces thereof are tapered surfaces gradually expanding upward. Thus, by forming both the end surfaces of the first introduction portion 14*b* into tapered surfaces, the first signal line 21 is easily introduced and inserted into the first hole portion 14*a*.

The second side wall portion 13 is formed into a substantial inverted L shape together with a vertical portion 13*a* and a horizontal portion 13*b*. This horizontal portion 13*b* is a contact part that comes into surface contact with a shield cover 400 of the connector A.

This second side wall portion 13 is provided with a plurality of second slots 15 into which the first shield conductors exposed from the first external insulators 23 of the plurality of composite cables 20 are inserted, at predetermined intervals in a longitudinal direction of the relevant second side wall portion 13.

The second slot 15 has a circular ark second hole portion 15*a* formed in the vertical portion 13*a* of the second side wall portion 13, and a second introduction portion 15*b* formed in the horizontal portion 13*b* of the second side wall portion 13.

The second hole portion 15*a* is a circular hole that has a little smaller diameter than the first shield conductor 22 of the composite cable 20 and opens at an upper portion thereof, and a width dimension of both edge portions of the opening portion thereof is made smaller than a diameter of the first shield conductor 22. This allows the first shield conductor 22 to be press-fitted into the second hole portion 15*a* and be held. In this manner, press-fitting the first shield conductor 22 into the second hole portion 15*a* brings both into contact, resulting in electrical connection. Moreover, press-fitting the first shield conductor 22 into the second hole portion 15*a* prevents the relevant first shield conductor 22 from dropping off from the second slot 15 at the time of attachment to the attachment part 10 and at the time of attachment of the attachment part 10 to the connector A. The second hole portion 15*a* is formed so as to be sized such that the relevant first shield conductor 22 is not ruptured when the first shield conductor 22 is press-fitted.

Moreover, the second introduction portion 15*b* is an opening continuing from the opening portion of the second hole portion 15*a*, and both end surfaces thereof are tapered surfaces gradually expanding upward. Thus, by forming both the end surfaces of the second introduction portion 15*b* into tapered surfaces, the first shield conductor 22 is easily introduced and inserted into the second hole portion 15*a*.

Hereinafter, a procedure for attaching the composite cables 20 to the attachment part 10 having such a constitution, and aligning and positioning the four first signal lines 21 of the composite cables 20 in a predetermined order is described.

First, the first external insulators 23 of tip portions of the composite cables 20 are taken off to expose the first shield conductors 22. Then, tip portions of the relevant first shield conductors 22 are taken off to expose the four first signal lines 21. Furthermore, tip portions of the first internal insulators 21*b* of the relevant first signal lines 21 are taken off to expose the first connecting conductors 21*a*.

Thereafter, the exposed first shield conductors 22 of the composite cables 20 are inserted into the second introduction portions 15*b* of the second slots 15 of the relevant attachment part 10 from above to be press-fitted into the second hole portions 15*a*. At this time, the first shield conductors 22 of the composite cables 20 come into contact with the second hole portions 15*a*, and are electrically connected.

At the same time, referring to colors given to the relevant first signal lines 21, the exposed first signal lines 21 of the composite cables 20 are inserted into the first introduction portions 14*b* of the first slots 14 of the attachment part 10 from above in the predetermined order to be press-fitted into the first hole portions 14*a*. In this manner, the four first signal lines 21 of the plurality of composite cables 20 are aligned and positioned in the predetermined order.

Thereafter, whether or not the four first signal lines 21 of the respective composite cables 20 are aligned in the predetermined order is checked. Specifically, the first signal lines 21 are checked by visual confirmation from between the first side wall portion 12 and the second side wall portion 13 of the attachment part 10. As a result, if miswiring of the first signal lines 21 is found, the relevant first signal lines 21 are taken out of the slots 14 to be reinserted into the proper first slots 14.

According to such an attachment part 10, only by inserting the four first signal lines 21 of the respective composite cables 20 into the plurality of first slots 14, the relevant first signal lines 21 can be easily aligned and positioned in the predetermined order. Additionally, the four first signal lines 21 of the composite cables 20 can be visually confirmed from between the first side wall portion 12 and the second side wall portion 13 of the attachment part 10 to thereby check the alignment. That is, the alignment of the first signal lines 21 can be easily checked before the attachment of the connector A. As a result of this check, if miswiring of the first signal lines 21 is found, the first signal lines 21 are only taken out of the first slots 14 to be reinserted into the proper first slots 14, and thus, the first signal lines 21 can be rewired easily. Therefore, the failure of the composite cable 20 and the connector A due to the connection of the miswired first signal lines 21 to terminal portions 100 of the connector A can be prevented.

Figure 3:
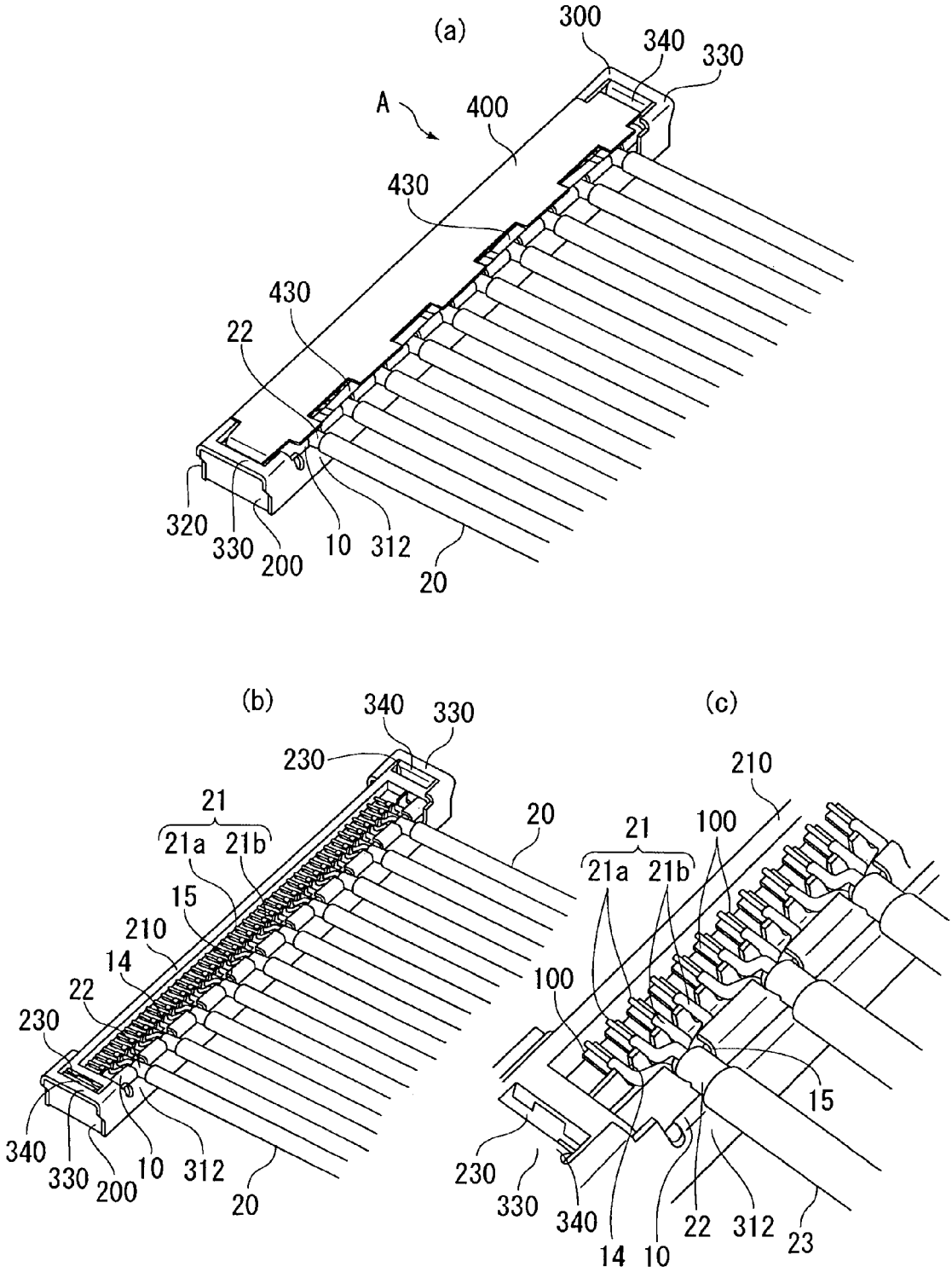
FIG. 3 is schematic perspective views showing an attachment state of the attachment part of the connector according to the first embodiment of the present invention, (a) being a view of a shield cover attached state, (b) being a view of a shield cover removed state, (c) being a partial enlarged view of (b)
Figure 7:
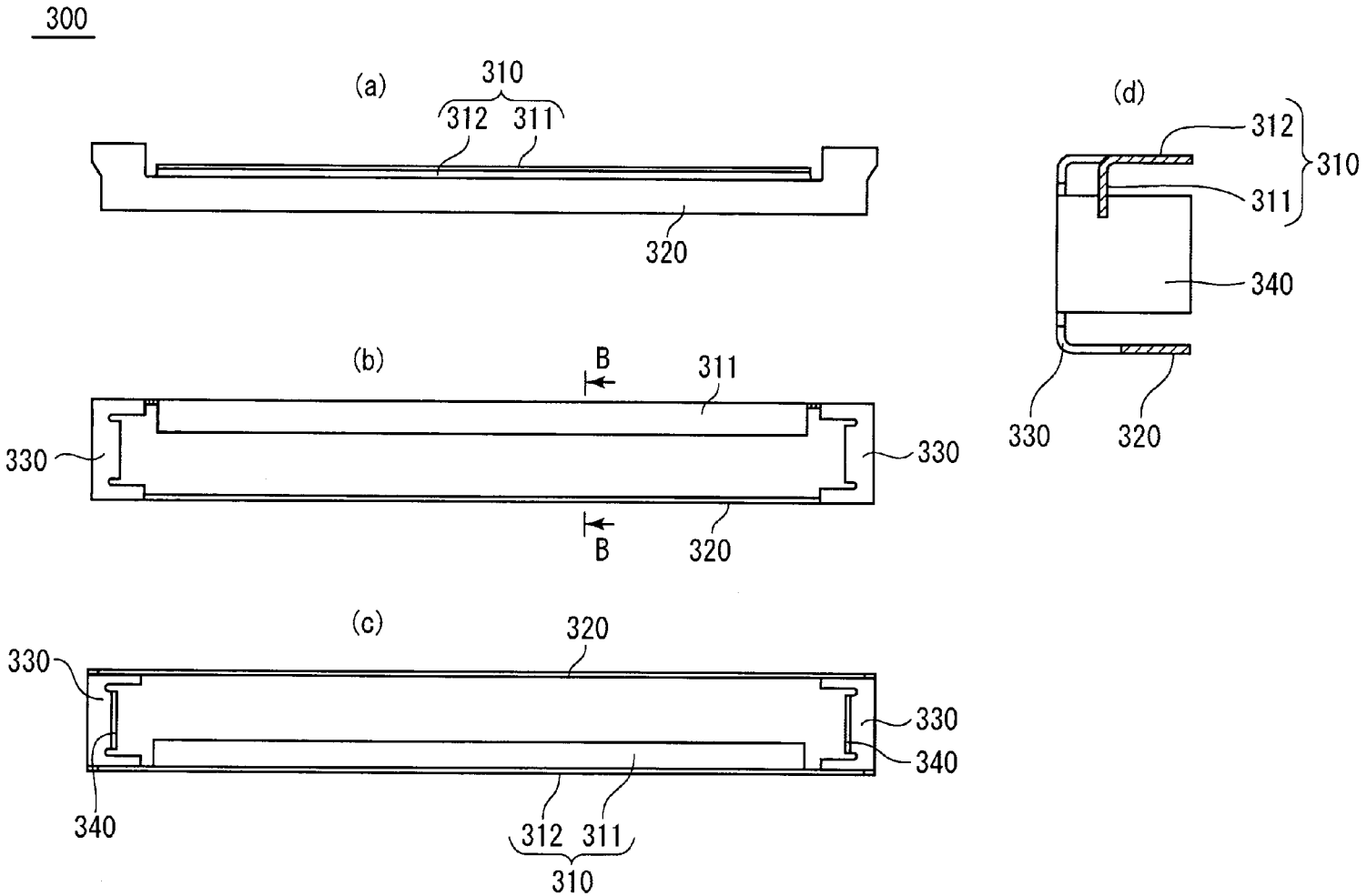
FIG. 7 is views of a shield member of the same connector, (a) being a front view, (b) being a plane view, (c) being a bottom view, (d) being a B-B cross-sectional view.
Figure 8:
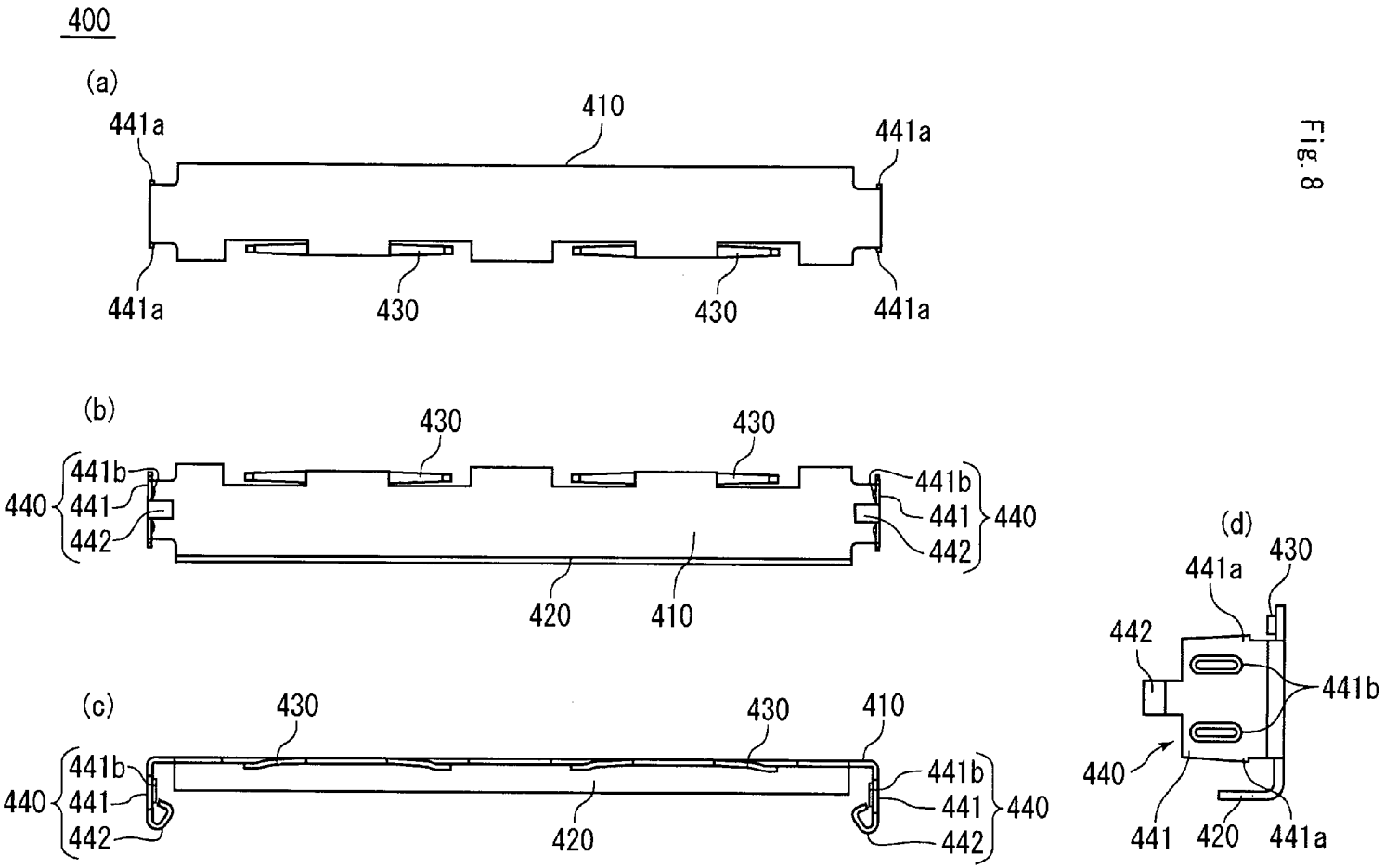
FIG. 8 is views showing the shield cover of the same connector, (a) being a plane view, (b) being a bottom view, (c) being a back view, (d) being a side view.

Hereinafter, the connector A to which the attachment part 10 with the plurality of composite cables 20 attached is attached and to which the first signal lines 21 of the composite cables 20 are electrically connected in this manner is described with reference to the drawings. FIG. 3 is schematic perspective views showing an attached state of the attachment part of the connector according to the first embodiment of the present invention, (a) being a view of a shield cover attached state, (b) being a view of a shield cover removed state, (c) being a partial enlarged view of (b), FIG. 4 is a schematic cross-sectional view showing the attachment state of the attachment part of the same connector, FIG. 5 is a schematic exploded perspective view of the same connector, FIG. 6 is views showing a body provided with the terminal portions of the same connector, (a) being a front view, (b) being a plane view, (c) being an A-A cross-sectional view, FIG. 7 is views of a shield member of the same connector, (a) being a front view, (b) being a plane view, (c) being a bottom view, (d) being a B-B cross-sectional view, and FIG. 8 is views showing the shield cover of the same connector, (a) being a plane view, (b) being a bottom view, (c) being a back view, (d) being a side view.

Figure 4:
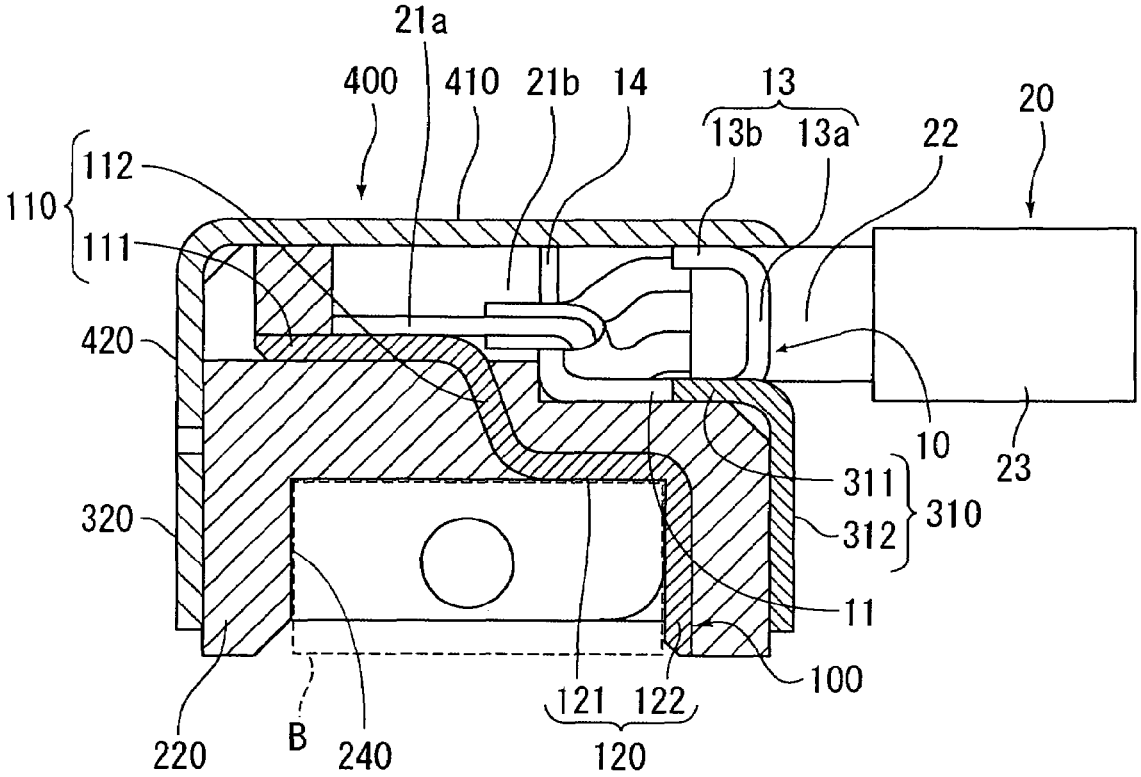
FIG. 4 is a schematic cross-sectional view showing the attachment state of the attachment part of the same connector.
Figure 5:
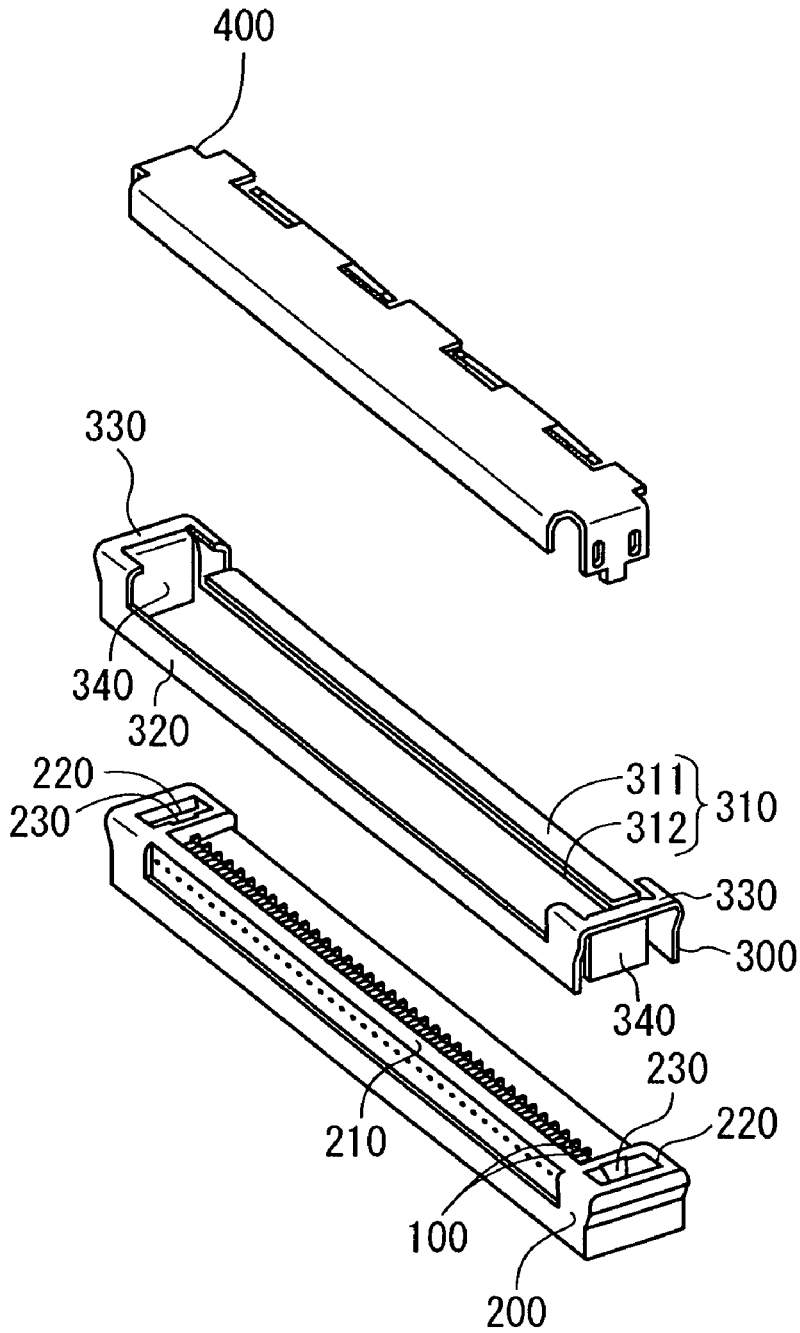
FIG. 5 is a schematic exploded perspective view of the same connector.

The connector A shown in FIGS. 3 and 4 includes the plurality of terminal portions 100 electrically connected to the first connecting conductors 21*a* of the first signal lines 21 of the plurality of composite cables 20, a body 200 in which the plurality of terminal portions 100 are provided in a row in a longitudinal direction, a shield member 300 which is attached to this body 200 and on which the attached part 10 is placed, and a shield cover 400 which is attached to the body 200 and holds the attached part 10 between the shield member 300 and itself.

This connector A is used in such a manner as to be connected to a counterpart connector B mounted on a substrate of an electronic device not shown in the figure (refer to FIG. 4). As one example, the connectors A are used in such a manner as to be attached to both end portions of the composite cables 20 in a longitudinal direction, and be connected to a counterpart connector B mounted on a substrate on a body side part where key switches and the like of a foldable portable telephone set (electronic device) are arranged and a counterpart connector B mounted on a substrate of a display side part where a liquid crystal display and the like of the relevant portable telephone set are arranged, respectively. Naturally, the connector A can also be used in such a manner that it is connected to only one end portions of the composite cables 20, and the other end portions of the relevant composite cables 20 are connected directly to respective units of the electronic device.

Figure 6:
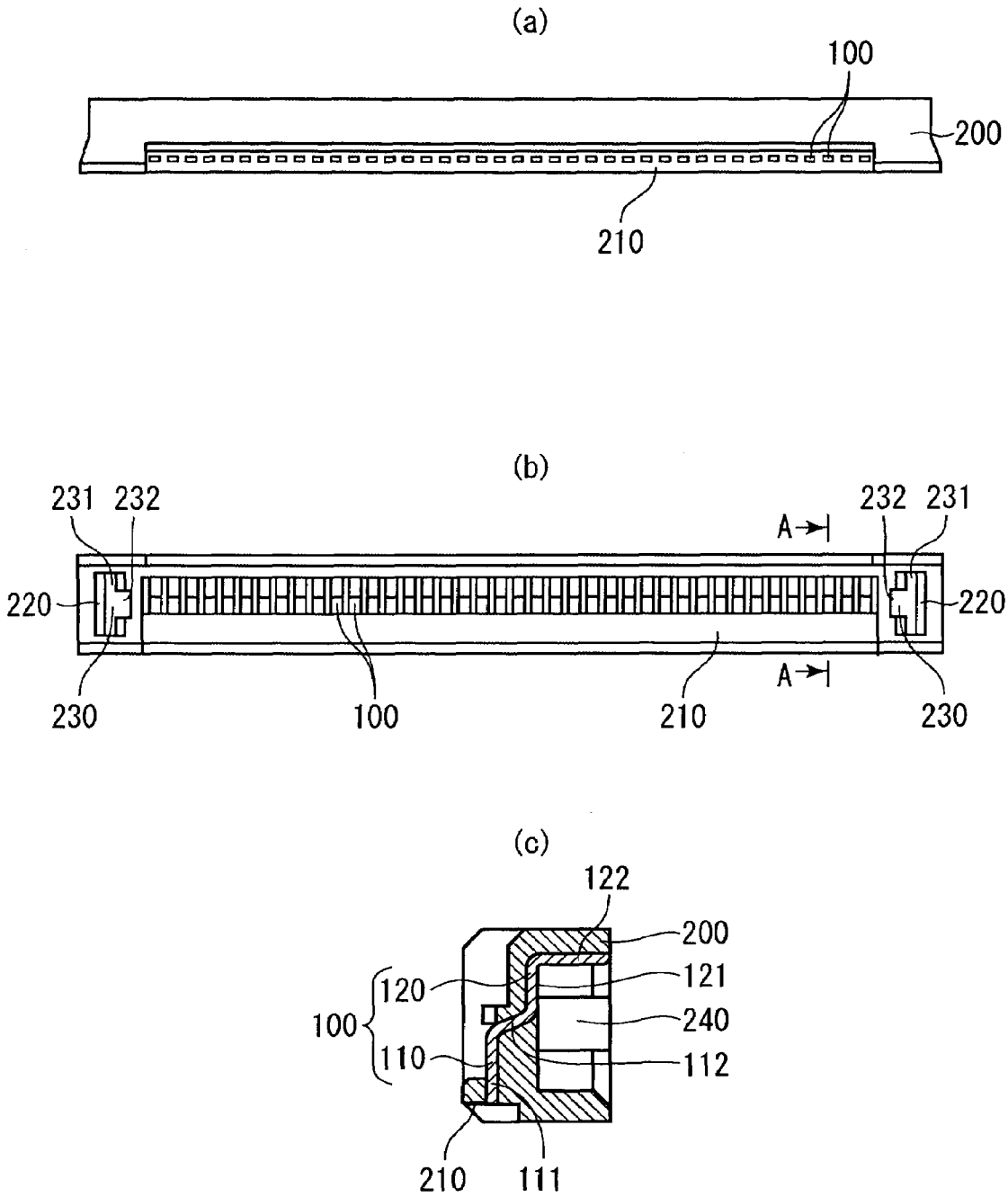
FIG. 6 is views showing a body provided with the terminal portions of the same connector, (a) being a front view, (b) being a plane view, (c) being an A-A cross-sectional view.

The body 200, as shown in FIGS. 4 and 6, is a substantially rectangular resin product of liquid crystal polyester (LCP) resin having insulation properties or the like, and in a central portion thereof, the plurality of terminal portions 100 are insert-molded in a row in a longitudinal direction. On one end side in a width direction of a top surface of the central portion of this body 200 is provided a protrusion 210 that holds tip portions of horizontal portions 111 of upper step portions 110 of the terminal portions 100 along the longitudinal direction.

Moreover, in the top surface of both end portions of the body 200 in the longitudinal direction, there are provided a pair of recessed portions 220 and a pair of projected locking bore portions 230 in a plane view, which are provided so as to communicate with the inside of this pair of recessed portions 220, as shown in FIGS. 3(*b*), (*c*), and 6(*b*). A pair of insertion plates 340 of the shield member 300 is inserted into the pair of recessed portions 220. The pair of locking bore portions 230 has a pair of rectangular first bore portions 231, and a pair of second bore portions 232 whose width is smaller than that of the relevant first bore portions, inside of these first bore portions 231, and a pair of locking portions 440 of the shield cover 400 is inserted into the locking bore portions 230.

Furthermore, in a central portion of a bottom surface of the body 200, as shown in FIGS. 4 and 6(*c*), there is provided a recessed opening portion 240 for exposing vertical portions 122 of lower step portions 120 of the terminal portions 100. The counterpart connector B is fitted into this opening portion 240.

Each of the terminal portions 100, as shown in FIGS. 4 and 6(*c*), is a conductor of copper alloy or the like, which is bent in a stepwise manner, and has the upper step portion 110 and the lower step portion 120.

The upper step portion 110 has the horizontal portion 111, and an inclined portion 112 extending obliquely downward from this horizontal portion 111. On the other hand, the lower step portion 120 has a horizontal portion 121 extending horizontally from the inclined portion 112 and the vertical portion 122 extending vertically from this horizontal portion 121.

The inclined portion 112 and the horizontal portion 121 are held parts that are held by the body 200. The horizontal portion 111 is exposed on the top surface of the body 200, and the tip portion thereof is held by the protrusion 210 of the body 200. That is, a base end portion of the horizontal portion 111 forms a connection part with the connecting conductor 21*a* of a composite cable 20. The vertical portion 122 is exposed from another end side in a width direction of the opening portion 240 to form a connection part that is electrically connected to a contact of the counterpart connector B fitted into the relevant opening portion 240, which is not shown in the figure.

The shield member 300, as shown in FIGS. 5 and 7, is a frame made of SUS, and has a substantially L-shaped first shield piece 310 in a cross-sectional view, a long-plate-like second shield piece 320, a pair of joining portions 330 joining both end portions of the first and second shield pieces 310, 320 in a longitudinal direction, and the pair of insertion plates 340 provided downward from this pair of joining portions 330.

The first shield piece 310, as shown in FIG. 4, has a horizontal plate 311 contacting another end side of the top surface of the body 200 in the width direction, and a vertical plate 312 continuing from this horizontal plate 311 and contacting another end side of the body 200 in the width direction. The horizontal plate 311 is located above the lower step portions 120 of the terminal portions 100 with the relevant body 200 interposed in a state of contacting the other end portion of the top surface of the body 200 in the width direction. Moreover, the attachment part 10 is placed on this horizontal portion 311 and is connected by soldering, by which the relevant horizontal plate 311 is located between the lower step portions 120 of the terminal portions 100 and the attachment part 10.

The second shield piece 320 is opposed to the vertical plate 312 of the first shield piece 310 and contacts a lower portion of one end surface of the body 200 in the width direction.

The pair of insertion plates 340 is inserted into the pair of recessed portions 220 of the body 200 to be located on both sides of the central portion (that is, terminal portions 100 arranged area) of the relevant body 200. This allows the shield member 300 to be attached to the body 200, thereby bringing the respective portions of the relevant shield member 300 into contact with the respective portions of the body 200 as described above.

The shield cover 400, as shown in FIGS. 5 and 8, is a part made of SUS, and has a long-plate-like body 410, a long-plate-like front surface portion 420 provided downward from one end of this body portion 410 in a width direction, four piece members 430 provided from another end portion of the body portion 410 in the width direction at predetermined intervals, and locking portions 440 provided downward from both ends of the body portion 410 in a longitudinal direction.

The body portion 410, as shown in FIG. 4, is placed on the protrusion 210 of the body 200 to cover the top surface of the relevant body 200 and one end portions in the longitudinal direction of the composite cables 20 connected to the terminal portions 100. In a state where the body portion 410 covers the one end portions of the composite cables 20, the piece members 430 contact the horizontal portion 13*b* of the second side wall portion 13 of the attachment part 10 together with the other end portion of the body portion 410 in the width direction to be connected by soldering. Both end portions of these piece members 430 are bent downward, and press the relevant attachment portion 10 toward the horizontal plate 311 of the first shield piece 310 of the shield member 300. This attains stable electric connection of the attachment part 10, the shield member 300 and the shield cover 400.

The front surface portion 420 covers a front side of the protrusion 210 of the body 200 (that is, one end side of the body 200 in the width direction) and an upper portion of the one side surface of the body 200 in the width direction.

The locking portions 440, as shown in FIG. 8, each have a press-fitting plate 441 that is press-fitted into the first bore portion 231 of the locking bore portion 230 of the body 200, and a locking claw 442 provided downward from this press-fitting plate 441.

The press-fitting plate 441 is provided with a pair of projected portion 441*a* in both end portions in the width direction. This makes a width dimension of the press-fitting plate 441 a little larger than a length dimension of the first bore portion 231 of the locking bore portion 230 of the body 200. In this manner, the press-fitting plate 441 can be press-fitted into the first bore portion 231 of the locking bore portion 230 of the body 200. The projected portions 441*a* are inclined downward, which makes it easy to press-fit the press-fitting plate 441 into the locking bore portion 230.

Moreover, the press-fitting plate 441 is provided with a pair of bulged portions 441*b* that is bulged inward. This pair of bulged portions 441*b* contacts an inner wall surface inside of the first bore portion 231 of the locking bore portion 230. This prevents the shield cover 400 from playing in the attached state. Also, the contact of the pair of bulged portions 441*b* with the inner wall surface of the first bore portion 231 of the locking bore portion 230 allows an outer surface of the press-fitting plate 441 to contact the insertion plate 340 of the shield member 300, which is inserted into the recessed portion 220 on the outer side of locking bore portion 230. In this manner, the press-fitting plate 441 presses the insertion plate 340 of the shield member 300 between the inner wall surface of the recessed portion 220 on the outer side and itself, which prevents the shield member 300 from playing.

The locking claw 442 fits into the first and second bore portions 231, 232 of the locking bore portion 230 of the body 200. In this state, a tip portion of the locking claw 442 is slightly projected from the bottom surface of the body 200. That is, the locking claw 442 is a connection part that is connected to a ground line of the substrate of the electronic device.

Hereinafter, the assembling process of the above-described connector A is described. First, the pair of insertion plates 340 of the shield member 300 is inserted into the pair of recessed portions 220 of the body 200 having the terminal portions 100 insert-molded. Then, as shown in FIG. 4, the first shield piece 310 of the shield member 300 contacts, and extends along the other end portion of the top surface of the body 200 in the width direction, and the other end surface thereof in the width direction. At the same time, the second shield piece 320 of the shield member 300 contacts and extends along the lower portion of the one end surface of the body 200 in the width direction.

Thereafter, the first connecting conductors 21*a* of the first signal lines of the composite cables 20 attached to the attachment part 10 are placed on the base end portions (exposed portions) of the horizontal portions 111 of the upper step portions 110 of the terminal portions 110, and the attached part 10 is placed on the horizontal plate 311 of the first shield piece 310 of the shield member 300. That is, the bottom plate portion 11 of the attached part 10 is brought into surface contact with the horizontal plate 311 of the first shield piece 310 of the shield member 300. In this state, the first connecting conductors 21*a* of the first signal lines 21 are connected to the horizontal portions 111 of the terminal portions 100, and the attachment part 10 is connected to the horizontal plate 311 of the shield member 300 by soldering.

Thereafter, the pair of locking portions 440 of the shield cover 400 is inserted into the pair of locking bore portions 230 of the body 200 to be locked. Consequently, the body portion 410 of the shield cover 400 is placed on the protrusion 210 of the body 200 to cover the top surface of the relevant body 200 and the one end portions of the composite cables 20 in the longitudinal direction, which are connected to the terminal portions 100, and part of the other end portion of the body portion 410 of the relevant shield cover 400 in the width direction and the piece members 430 are placed on the attachment part 10. Moreover, at the same time, the front surface portion 420 of the shield cover 400 covers the front side of the protrusion 210 of the body 200 and the upper portion of the one side surface of the body 200 in the width direction.

The counterpart connector B mounted on the substrate of the electronic device is fitted into the opening portion 240 of the body 200 of the connector A assembled in this manner. Consequently, the contact of the counterpart connector B contacts the vertical portions 122 of the lower step portions 120 of the terminal portions, which are exposed from the opening portion 240 of the body 200, resulting in electric connection between both. At this time, the locking claws 442 of the pair of locking portions 440 of the shield cover 400, which are projected from the bottom surface of the body 200, contact the ground line of the substrate of the electronic device, and are electrically connected to it.

According to the above-described connector A, since the respective first signal lines 21 of the composite cables 20 are aligned by the attachment part 10 in the predetermined order in advance, and the relevant alignment has been checked, miswiring does not occur. Additionally, since the attachment part 10 also serves as a ground bar, the number of parts can be reduced, and the connection of the composite cables 20 to the ground becomes easier. Moreover, only holding the attachment part 10 between the shield member 300 and the shield cover 400 allows the relevant attachment part 10 to be incorporated into the connector A. That is, since the attachment part 10 can be incorporated easily, low cost can be achieved.

Additionally, since both ends in the width direction and the top surface of the body 200 can be shielded by the shield member 300 and the shield cover 400, and both sides of the central portion (that is, terminal portion 100 arranged area) of the relevant body 200 in the longitudinal direction can be shielded by the pair of insertion plates 340 of the shield member 300 and the pair of locking portions 440 of the shield cover 400, signals leaking out from the first shield conductors 22 of the composite cables 20 can be shut off not to affect the respective units of the electronic device on which the relevant connector A is mounted. Moreover, since the first shield piece 310 of the shield member 300 is located between the lower step portions 120 of the terminal portions 100 and the attachment part 10, a signal leaking out from the shield conductor 22 of the composite cable 20 can be shut off not to affect the adjacent terminal portion 100, which can reduce cross talk. Therefore, this attains a connector having high shield properties.

Furthermore, since both of the shield member 300 and the shield cover 400 are connected to the attachment part 10 by soldering, holding force for the attachment part 10 and the composite cables 10 can be improved. Therefore, even if the composite cables 20 are pulled upward, disconnection or soldering detachment in the soldering connection portions between the first connecting conductors 21*a* of the first signal lines 21 of the relevant composite cables 20 and the terminal portions 100 can be prevented.

Embodiment 2

Figure 9:
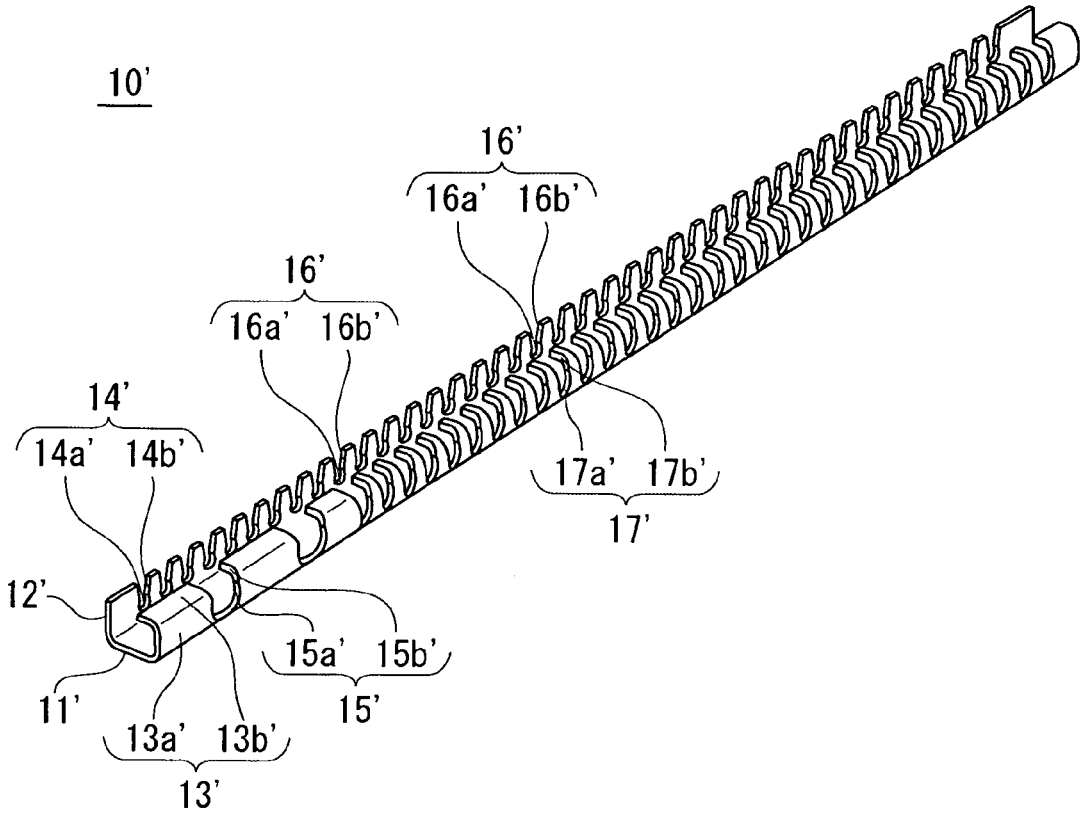
FIG. 9 is a schematic perspective view of the attachment part according to a second embodiment of the present invention.

Next, an attachment part according to a second embodiment of the present invention is described with reference to the drawings. FIG. 9 is a schematic perspective view of the attachment part according to the second embodiment of the present invention, FIG. 10 is schematic perspective views showing a cable attached state of the attachment part of FIG. 9, (a) being a view showing the whole, and (b) being a view where a part of (a) is enlarged, and FIG. 11 is schematic perspective views of a connector in a state where the same attachment part is attached and the shield cover is removed, (a) being a view showing the whole, (b) being a view where a part of (a) is enlarged.

Figure 10:
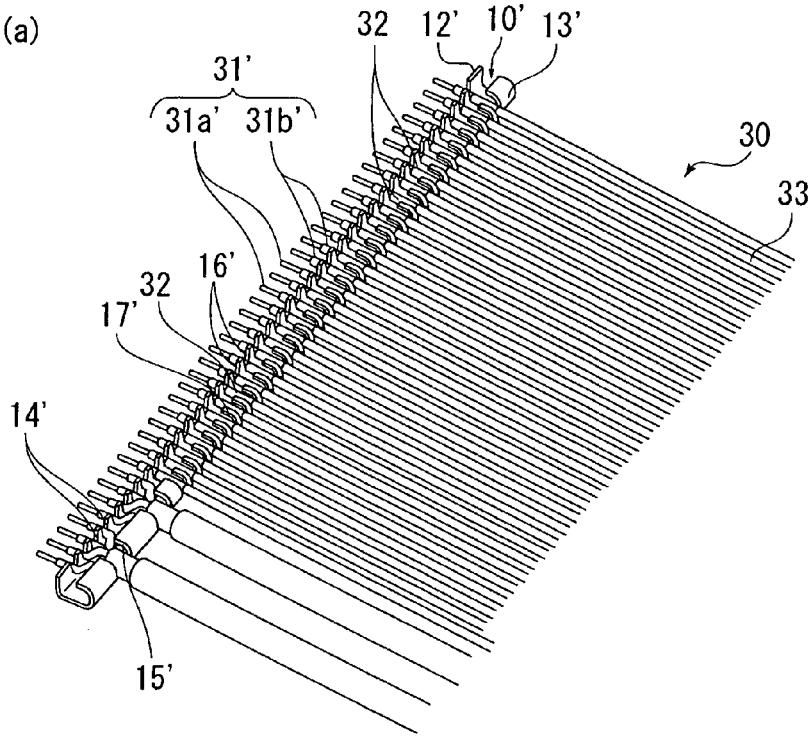
FIG. 10 is schematic perspective views showing a cable attached state of the attachment part of FIG. 9, (a) being a view showing the whole, (b) being a view where a part of (a) is enlarged.
Figure 10:
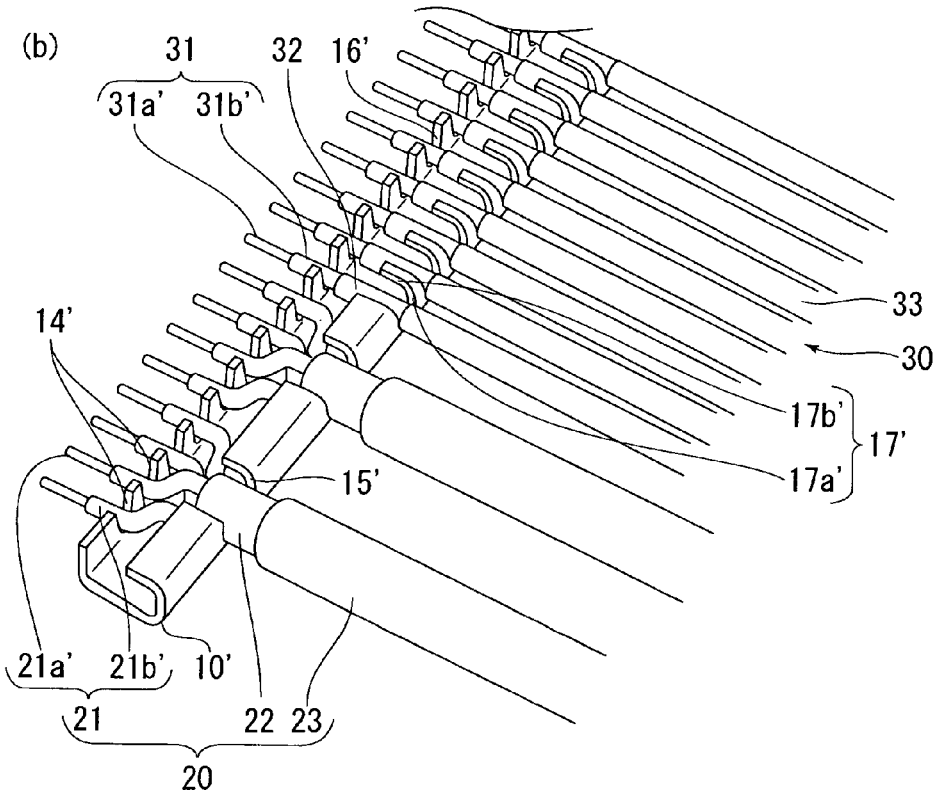
Figure 11:
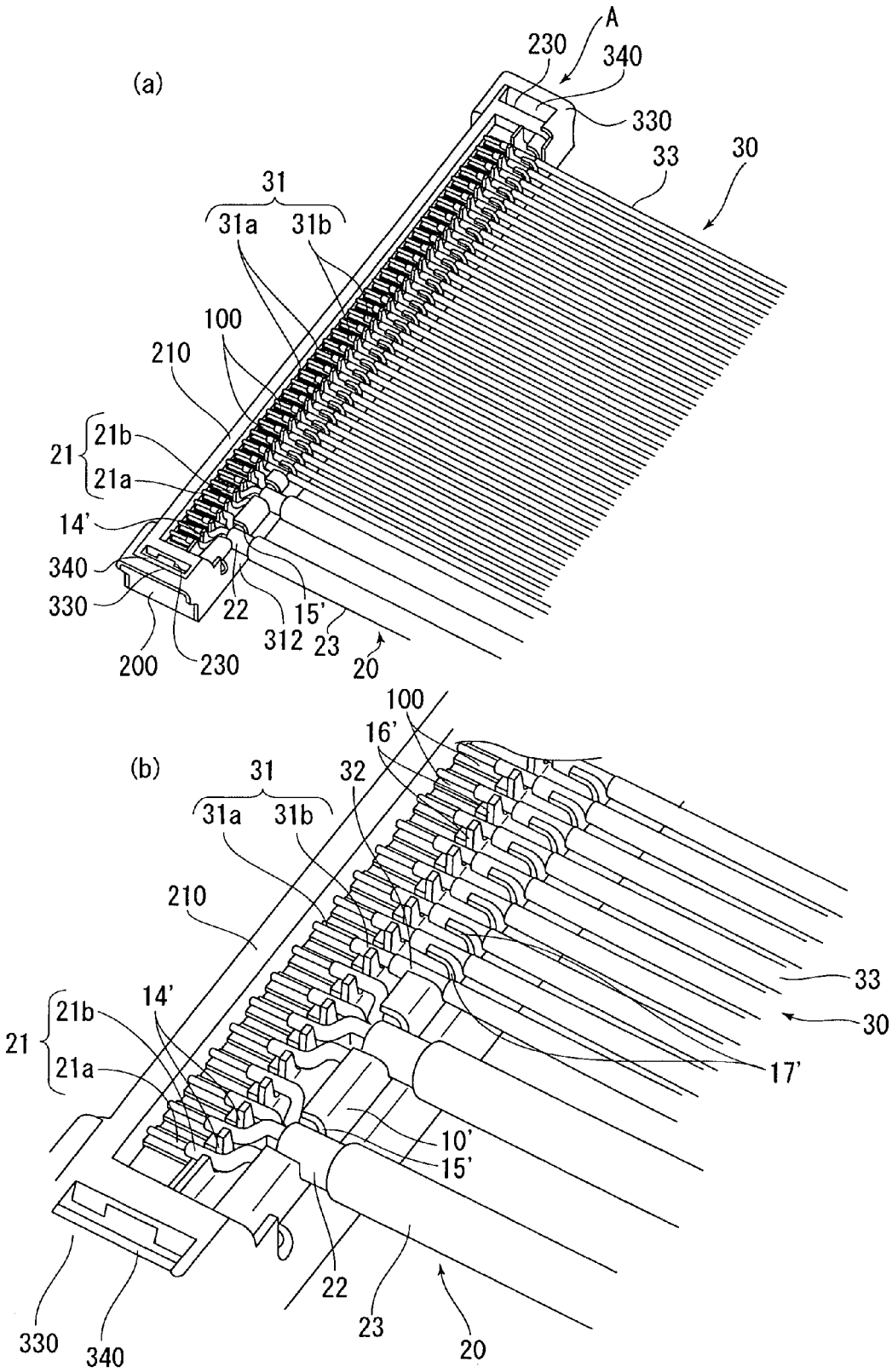
FIG. 11 is schematic perspective views of a connector in a state where the same attachment part is attached and a shield cover is removed, (a) being a view showing the whole, (b) being a view where a part of (a) is enlarged.

An attachment part 10' shown in FIGS. 9 and 10, is different from the attachment part 10 of Embodiment 1 in that coaxial cables 30 are attached in addition to the composite cables 20. Hereinafter, the different point is described in detail, and descriptions of overlapping parts are omitted. The numeral of the attachment part 10 is apostrophized.

The coaxial cable 30 has a second signal line 31 in which a second connecting conductor 31*a* is covered with a second internal insulator 31*b* formed of polyethylene or the like, a second shield conductor 32 formed of aluminum or the like that covers this second signal line 31, and a second external insulator 33 covering this second shield conductor 32.

In a first side wall portion 12' of the attachment part 10', a plurality of first slots 14', a plurality of third slots 16' into which the second signal lines 31 of the plurality of coaxial cables 30 are inserted are provided at predetermined intervals in a longitudinal direction of the first side wall portion 12'. On the other hand, in a second side wall 13' of the attachment part 10', a plurality of second slots 15' and fourth slots 17' into which the second shield conductors 32 of the plurality of coaxial cables 30 are inserted are provided at predetermined intervals in the longitudinal direction of the second side wall portion 13'.

The first slots 14' and the second slots 15' are the same as the first slots 14 and the second slots 15.

The third slots 16' is a U-shaped groove portion, and has a third hole portion 16*a'* forming a lower portion and a third introduction portion 16*b'* forming an upper portion.

The third hole portion 16*a'* is a circular hole that has a little smaller diameter than the second signal line 31 of the coaxial cable 30 and opens at an upper portion thereof, and a width dimension of both edge portions of the opening portion is made smaller than a diameter of the second signal line 31. This allows the second signal line 31 to be press-fitted into the third hole portion 16*a'* and be held. Moreover, press-fitting the second signal line 31 into the third hole portion 16*a'* prevents the relevant second signal line 31 from dropping off from the third slot 16' at the time of attachment to the attachment part 10' and at the time of attachment of the attachment part 10' to the connector A. The third hole portion 16*a'* is formed so as to be sized such that the second internal insulator 31*b* of the second signal line 31 is not ruptured when the second signal line 31 is press-fitted.

Furthermore, the third introduction portion 16*b'* is an opening continuing from the opening portion of the third hole portion 16*a'*, and both end surfaces thereof are tapered surfaces gradually expanding upward. In this manner, forming both the end surfaces of the third introduction portion 16*b'* into tapered surfaces makes it easy to introduce the second signal line 31 to the third hole portion 16*a'*.

The fourth slot 17' has a circular ark fourth hole portion 17*a'* formed in a vertical portion 13*a'* of a second side wall portion 13', and a fourth introduction portion 17*b'* formed in a horizontal portion 13*b'* of the second side wall portion 13'.

The fourth hole portion 17*a'* is a circular hole that has a little smaller diameter than the second shield conductor 32 of the coaxial cable 30 and opens at an upper portion thereof, and a width dimension of both edge portions of the opening portion thereof is made smaller than a diameter of the second shield conductor 32. This allows the second shield conductor 32 to be press-fitted into the fourth hole portion 17*a'* and be held. In this manner, press-fitting the second shield conductor 32 into the fourth hole portion 17*a'* brings both into contact, resulting in electrical connection. Moreover, press-fitting the second shield conductor 32 into the fourth hole portion 17*a'* prevents the relevant second shield conductor 32 from dropping off from the fourth slot 17' at the time of attachment to the attachment part 10' and at the time of attachment of the attachment part 10' to the connector A. The fourth hole portion 17*a'* is formed so as to be sized such that the relevant second shield conductor 32 is not ruptured when the second shield conductor 32 is press-fitted.

Moreover, the fourth introduction portion 17*b*' is an opening continuing from the opening portion of the fourth hole portion 17*a*', and both end surfaces thereof are tapered surfaces gradually expanding upward. In this manner, forming both the end surfaces of the fourth introduction portion 17*b*' into tapered surfaces makes it easy to introduce the second shield conductor 32 to the fourth hole portion 17*a*'.

Hereinafter, a procedure for attaching the coaxial cables 30 to the attachment part 10' having such a constitution is described. Since the attachment method of the composite cables 20 and the procedure of aligning and positioning the four first signal lines 21 of the relevant composite cables 20 in the predetermined order are the same as those in Embodiment 1, descriptions thereof are omitted.

First, the second external insulators 33 of tip portions of the coaxial cables 30 are taken off to expose the second shield conductors 32. Then, tip portions of the relevant second shield conductors 32 are taken off to expose the second signal lines 31. Furthermore, tip portions of the second internal insulators 31*b* of the relevant second signal lines 31 are taken off to expose the second connecting conductors 31*a*.

Thereafter, the exposed second shield conductors 32 of the coaxial cables 30 are inserted into the fourth introduction portions 17*b*' of the fourth slots 17' of the relevant attachment part 10' from above to be press-fitted into the fourth hole portions 17*a*'. At this time, the second shield conductors 32 of the coaxial cables 30 come into contact with the fourth hole portions 17*a*', and are electrically connected with them.

At the same time, the exposed second signal lines 31 of the coaxial cables 30 are inserted into the third introduction portions 16*b*' of the third slots 16' of the attachment part 10' from above to be press-fitted into the third hole portions 16*a*'. In this manner, the plurality of coaxial cables 30 are aligned and positioned.

In this manner, the attachment part 10' with the composite cables 20 and the coaxial cables 30 attached also is attached to the connector A of Embodiment 1. That is, as shown in FIG. 11, the first connection conductor portions 21*a* of the first signal lines 21 of the composite cables 20, and the second connection conductor portions 31*a* of the second signal lines 31 of the coaxial cables 30 are connected to a part of the terminal portions 100 of the connector A, and the attachment part 10' is held between the shield member 300 and the shield cover 400 to be connected by soldering.

According to the above-described attachment part 10', not only the composite cables 20 but also the coaxial cables 30 can be attached, and the arrangement and positioning can be performed easily. Moreover, such attachment part offers convenience in that only incorporating the attachment part 10' into the connector A allows the composite cables 20 and the coaxial cables 30 to be connected to the ground.

The above-described attachment part may be changed in design, as long as it has the plurality of first slots for receiving a plurality of the first signal lines exposed from the first external insulators and the first shield conductors of the composite cables.

Therefore, it is optional whether or not the attachment part is provided with the second slots 15, 15', the third slots 16', and/or the fourth slots 17'. Also, the attachment part can be provided with another slot to be capable of attaching a cable other than the coaxial cables 30.

While the first slots are adapted such that the signal lines of the composite cables are press-fitted, the first slots only need be adapted such that they can be inserted. In this regard, the second, third and fourth slots may be designed in a similar manner.

The first, second slots and the third, fourth slots may be disposed in any arrangement. For example, the first and second slots can be provided in the central portion of the attachment part 10' to allow the composite cables 20 to be attached in the central portion of the attachment part 10', and the third and fourth slots can be provided on opposite sides of the attachment part 10' to allow the coaxial cables 30 to be attached in the opposite end portions of the attachment part 10'.

Moreover, although the attachment part preferably has conductivity, the attachment part is not limited to this kind. That is, it can also be at least a part for arranging and positioning the first signal lines of the composite cables.

The body of the connector may be any one having an insulation property and being adapted to attach a plurality of terminal portions in a row thereto.

Any conductive terminal portions may be used. The shape of the terminal portions can be changed in design, as long as the terminal portions can be connected to the first connecting conductors of the composite cables.

Moreover, although the terminal portions are preferably connected by soldering to the first connection conductor portions exposed from the first internal insulators of the first signal lines of the composite cables and the second connection conductor portions exposed from the second internal insulators of the second signal lines of the coaxial cables, the terminal portions may also be brought into contact by pressurizing with the first connection conductor portions covered with the first internal insulators of the first signal lines of the composite cables and the second connection conductors covered with the second internal insulators of the second signal lines of the coaxial cables. In this case, each of the terminal portions is provided with a pressure-contact portion that pierces the first internal insulator of the first signal line of the composite cable and the second internal insulator of the second signal line of the coaxial cable to contact the first connection conductor portion and the second connection conductor portion.

Although it is desirable that the shield member has the first and second shield pieces 310 and 320 to improve the shield properties, it only needs to have at least the first shield piece 310. Although the shield member is preferably attached to the body, it may be provided integrally with the body.

Although it is desirable that the shield cover is adapted to cover the top surface of the body to improve the shield properties, any one that can hold the attachment part between the shield member and itself may be used. Accordingly, it is optional whether or not the shield cover is provided with the piece members.

Moreover, although it is desirable that either of the shield member and the shield cover is connected to the attachment part by soldering, the soldering connection is not required in the case where predetermined holding force can be obtained by holding between the shield member and the shield cover.

Any composite cable can be used as long as it has a plurality of first signal lines in which the first connecting conductors are covered with the first internal insulators, and the first shield conductor covering the whole of this plurality of first signal lines.

As the electronic device, it goes without saying that the present invention can be used for not only the above-described portable telephone but also other electronic devices such as a portable movable terminal device such as a PDA (personal digital assistant), a digital camera, a digital video camera, a personal computer and the like.

What is claimed is:

1. An attachment part to attach a composite cable thereto, the composite cable comprising:

a plurality of first signal lines in which first connecting conductors are covered with first internal insulators;

a first shield conductor covering the whole of the plurality of first signal lines; and a first external insulator covering this first shield conductor, wherein the attachment part is electrically conductive, has substantially a U-shape in a cross-sectional view, and comprises:

an elongated bottom plate;

a first elongated side wall provided upright at one widthwise end portion of the bottom plate;

a second elongated side wall provided upright at the other widthwise portion of the bottom plate;

a plurality of first slots formed in the first side wall to receive the plurality of first signal lines exposed from the first external insulator and the first shield conductor of the composite cable; and at least one second slot formed in the second side wall to receive and contact the first shield conductor exposed from the first external insulator of said composite cable;

wherein a ratio of the number of first slots to the number of the at least one second slots is equal to a ratio of the number of first signal lines to the number of first shield conductors in the composite cable.

2. The attachment part according to claim 1, wherein the first signal lines of said composite cable are press-fitted into respective first circular hole portions of said first slots that are a little smaller in diameter than the first signal lines.

3. The attachment part according to claim 1, wherein the first shield conductor of said composite cable is press-fitted into a respective second circular hole portion of said second slot that is a little smaller in diameter than the first shield conductor.

4. The attachment part according to claim 1 to attach thereto a coaxial cable in addition to said composite cable, the coaxial cable comprising:

a second signal line in which a second connecting conductor is covered with a second internal insulator;

a second shield conductor covering the second signal line; and a second external insulator covering this second shield conductor, the attachment part further comprising:

a third slot further formed in the first side wall to receive the second signal line exposed from the second external insulator and the second shield conductor of said coaxial cable; and a fourth slot further formed in the second side wall to receive and contact the second shield conductor exposed from the second external insulator of said coaxial cable.

5. The attachment part according to claim 4, wherein the second signal line of said coaxial cable is press-fitted into a respective third circular hole portion of said third slot that is a little smaller in diameter than the second signal line.

6. The attachment part according to claim 4, wherein the second shield conductor of said coaxial cable is press-fitted into a respective fourth circular hole portion of said fourth slot that is a little smaller in diameter than the second shield conductor.

7. A connector comprising:

the attachment part according to claim 4;

terminal portions for electrically connecting to the first connecting conductors of the composite cable and the second connecting conductor of the coaxial cable;

a body having an insulation property and being provided with the terminal portions, the terminal portions being arranged in the lengthwise direction of the body; and a shield member provided in this body for electrically connecting to said attachment part.

8. The connector according to claim 7, further comprising a shield cover for attaching to said body, wherein said shield member is arranged between said terminal portions and said attachment part, and wherein said shield cover holds the attachment part between said shield member and itself in an attached state to said body.

9. An electronic device comprising the connector attachment part according to claim 7.

10. The connector according to claim 9, wherein the second side wall of the attachment part is of an inverted L shape and comprises a vertical portion and a horizontal portion arranged perpendicular to the vertical portion, each of the terminal portion is bent in a stepwise manner and comprises:

a first end portion to be exposed at a top of the body and electrically connected with a corresponding one of the first connecting conductors; and a second end portion to be exposed at a bottom of the body, the shield member is disposed on at least a portion of the top of the body, the portion being above the second end portions of the terminal portions, and contacts the bottom plate of the attachment part, and the shield cover is mountable on the top of the body so as to have face-to-face contact with the horizontal portion of the attachment part.

11. The connector according to claim 8, wherein the second side wall of the attachment part is of an inverted L shape and comprises a vertical portion and a horizontal portion arranged perpendicular to the vertical portion, each of the terminal portion is bent in a stepwise manner and comprises:

a first end portion to be exposed at a top of the body and electrically connected with a corresponding one of the first connecting conductors; and a second end portion to be exposed at a bottom of the body, the shield member is disposed on at least a portion of the top of the body, the portion being above the second end portions of the terminal portions, and contacts the bottom plate of the attachment part, and the shield cover is mountable on the top of the body so as to have face-to-face contact with the horizontal portion of the attachment part.

12. A connector comprising:

the attachment part according to claim 1;

terminal portions for electrically connecting to the first connecting conductors of the composite cable;

a body having an insulation property and being provided with the terminal portions, the terminal portions being arranged in the lengthwise direction of the body; and a shield member provided in this body for electrically connecting to said attachment part.

13. The connector according to claim 12, further comprising a shield cover for attaching to said body, wherein said shield member is arranged between said terminal portions and said attachment part, and wherein said shield cover holds the attachment part between said shield member and itself in an attached state to said body.

14. An electronic device comprising the connector according to claim 12.

15. An electronic device comprising the connector according to claim 13.

16. An electronic device comprising the connector according to claim 8.

* * * * *